US005669557A

United States Patent [19]

Barrett et al.

[11] Patent Number: 5,669,557

[45] Date of Patent: Sep. 23, 1997

[54] SYSTEM AND PROCESS FOR SPRAYING AIR-DRYABLE LIQUID MATERIALS

[75] Inventors: Mark C. Barrett, New Hudson; Coy Barrett, Canton, both of Mich.

[73] Assignee: Tram-7 Precision, Inc., Redford, Mich.

[21] Appl. No.: 355,837

[22] Filed: Dec. 14, 1994

[51] Int. Cl.[6] ..... B05B 1/24; B05B 1/30

[52] U.S. Cl. ..... 239/135; 239/297; 239/300; 239/DIG. 14

[58] Field of Search ..... 239/8, 13, 135, 239/296, 297, 300, 413, 414, 415, 528, 527, DIG. 14; 118/302; 427/372.2, 377

[56] References Cited

U.S. PATENT DOCUMENTS

| | | | |
|---|---|---|---|
| Re. 33,481 | 12/1990 | Ziecker et al. | 239/298 |
| D. 281,391 | 11/1985 | Somers | D8/30 |
| D. 297,299 | 8/1988 | Krause | D8/30 |
| 4,065,057 | 12/1977 | Durmann | 239/79 |
| 4,200,234 | 4/1980 | Baldwin | 239/296 |
| 4,535,916 | 8/1985 | Macherle et al. | 272/113 |
| 4,637,745 | 1/1987 | Speisebecher et al. | 401/1 |
| 4,642,158 | 2/1987 | Steinel et al. | 156/497 |
| 4,713,257 | 12/1987 | Luttermoller | 239/8 X |
| 4,785,996 | 11/1988 | Ziecker et al. | 239/298 |
| 4,795,064 | 1/1989 | Sheu | 222/113 |
| 4,948,053 | 8/1990 | Hufgard | 239/301 |
| 4,949,881 | 8/1990 | Watanabe et al. | 222/113 |
| 4,957,783 | 9/1990 | Gabryszewski | 427/424 |
| 4,970,985 | 11/1990 | Slautterback | 118/300 |
| 5,026,188 | 6/1991 | Capodieci | 401/1 |
| 5,048,722 | 9/1991 | Lichu | 222/80 |
| 5,065,943 | 11/1991 | Boger et al. | 239/298 |
| 5,088,648 | 2/1992 | Schmon | 239/296 |
| 5,154,322 | 10/1992 | Sim | 222/146.2 |
| 5,160,763 | 11/1992 | Mims et al. | 427/207.1 |
| 5,169,070 | 12/1992 | Mattson | 239/290 |
| 5,478,014 | 12/1995 | Hynds | 239/135 |

FOREIGN PATENT DOCUMENTS

| | | | |
|---|---|---|---|
| 224611 | 6/1987 | European Pat. Off. | 239/135 |
| 935837 | 2/1956 | Germany | 239/135 |
| 3501446 | 7/1986 | Germany | 239/135 |

*Primary Examiner*—Lesley D. Morris

*Attorney, Agent, or Firm*—Harness, Dickey & Pierce, P.L.C.

[57] ABSTRACT

A system for spraying air-dryable liquid materials such as adhesives and paints and a method of using the system is disclosed. The system includes a hot air gun connected to both a source of hot pressurized air and a source of flowable liquid material. The gun includes a body having a handle assembly and a spraying assembly. The handle assembly includes a depressible trigger and first knob for adjusting the amount of liquid material in the spray and a second knob for adjusting the pattern of the spray. The spraying assembly includes a spray nozzle and control valves operably connected with the trigger for controlling the flow of pressurized hot air and liquid material. The spraying assembly also includes an air routing insert for routing air currents to the nozzle and a liquid material tube for routing liquid material to the nozzle. An air diverter assembly is also included for diverting an amount of heated air out of the front of the gun to aid in the drying of sprayed material. The liquid material is atomized upon leaving the nozzle when combined with the hot pressurized air.

25 Claims, 5 Drawing Sheets

SYSTEM AND PROCESS FOR SPRAYING AIR-DRYABLE LIQUID MATERIALS

BACKGROUND OF THE INVENTION

1. Technical Field

The present invention is generally directed to the application of liquid materials. More particularly, the present invention is directed to a system and process for spraying air-dryable liquid materials such as paints and adhesives.

2. Discussion

Adhesive materials are well-known and have been used since ancient times for providing or promoting adhesion between two articles. Earliest adhesives were based on naturally-occurring substances with little or no processing from their natural forms. Examples of some of these early adhesives include bitumen, fish oil, and certain tree resins. Many adhesives used today are still based on naturally-occurring substances, but have been subjected to processing.

The most notable development in adhesives in recent times has been the use of organic compound-based adhesives. These modern adhesives are based on the synthetic derivation of organic polymers. Solvent-based adhesives have been commonly used in the construction and manufacturing industries.

Typical of these types of adhesives is the "hot-melt" thermoplastic adhesive. Present-day versions of the hot-melt adhesive are composed of polymers such as ethylene-vinyl acetate copolymers, polyamides, polyesters, and polyethylene.

Hot-melt adhesives may be applied in a thick consistency or may be applied as a spray. Devices for spraying heated hot-melt adhesive materials are known. A typical example of such a device is disclosed in Re. U.S. Pat. No. 33,481, issued Dec. 11, 1990, to Ziecker et al. for ADHESIVE SPRAY GUN AND NOZZLE ATTACHMENT. The apparatus of the Ziecker et al. reference is directed to a spray system for spraying heated hot-melt adhesive in elongated strands or fibers in controlled spiral patterns.

In U.S. Pat. No. 5,065,943, issued Nov. 19, 1991, to Boger et al. for NOZZLE CAP FOR AN ADHESIVE DISPENSER a cap adapted for use with an adhesive dispensing device is disclosed. Like the device of Ziecker et al., the Boger et al. device lays down an elongated adhesive fiber onto a substrate in a controlled spiral pattern.

While these devices have utility in providing a method for dispensing solvent-based adhesives, these adhesives themselves are now generally regarded as being undesirable for widespread use. A popular solvent used in these adhesives has historically been trichlorofluoromethane (fluorotrichloromethane) derived from carbon tetrachloride and hydrogen fluoride. While providing very good adhesion, trichlorofluoromethane is now believed to be responsible in part fox depletion of the ozone layer. As a result, methylene chloride (dichloromethane) has been more recently substituted for trichlorofluoromethane to overcome the ozone-depletion problem inherent in its use. However, methylene chloride is itself now believed to pose a danger as a carcinogen. It is now apparent that while solvent-based adhesives provide very good adhesion characteristics, their usefulness is severely compromised by their known and suspected dangers to people and the environment.

As a substitute for these adhesives, water-based adhesives have been more recently used. While overcoming the chemical dangers of solvent-based adhesives, known systems for applying water-based adhesives satisfactorily are wanting.

SUMMARY OF THE INVENTION

It is therefore an object of the present invention to overcome the disadvantages of known solvent-based adhesives by providing an adhesive spraying system that utilizes liquid adhesives, particularly water-based adhesives.

It is a further object of the present invention to provide such a system which atomizes the liquid adhesive prior to its deposition on a substrate.

A further object of the present invention is to provide such a system that utilizes hot compressed air as a vehicle for atomizing and carrying the liquid adhesive to the target substrate.

Yet another object of the present invention is to provide a system for spraying adhesives that allows for adjustment of the spray pattern.

Still another object of the present invention is to provide such a system that is easy to operate and simple to maintain.

Yet a further object of the present invention is to provide a system for spraying air-dryable liquid materials in addition to liquid adhesives, such materials including paint.

The present invention achieves these objectives by providing a system and process for spraying a liquid adhesive that comprises a hot air gun connected to a source of hot pressurized air and a source of flowable adhesive.

The gun includes a body having a handle assembly and a spraying assembly. The handle assembly includes a depressible trigger, a knob for adjusting the amount of the air-dryable liquid material relative to hot pressurized air in the air-liquid spray, and a knob for adjusting the pattern of the spray.

The spraying assembly of the gun includes a central spray nozzle provided within a head module and shut-off valves operably connected with the trigger for selectively controlling the flow of incoming pressurized hot air and liquid material. The spraying assembly also includes an air routing insert for routing air currents around and in front of the nozzle and a liquid material fluid tube for routing another current of compressed air and liquid material through the nozzle. The liquid material and the hot compressed air within the tube combine at the nozzle tip and the liquid material is atomized. Additional opposed air channels are provided on the nozzle tip to allow passage of the air current directed around the front of the nozzle to fan the air-liquid material mixture so as to lay down a desired pattern of spray.

The hot pressurized air source includes a compressor for compressing ambient air, a heat exchanger for heating the compressed air, and regulators for regulating the pressure of the hot compressed air entering the heat exchanger.

The flowable liquid material source includes a tank for holding liquid material such as a paint or a glue, a compressor for pressurizing the liquid material in the tank, and a regulator for regulating the amount of the liquid material entering the gun from the tank.

Other objects and advantages of the present invention will be made apparent as the description progresses.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which.

DETAILED DESCRIPTION OF THE PREFERRED EMBODIMENT

Figure 1:
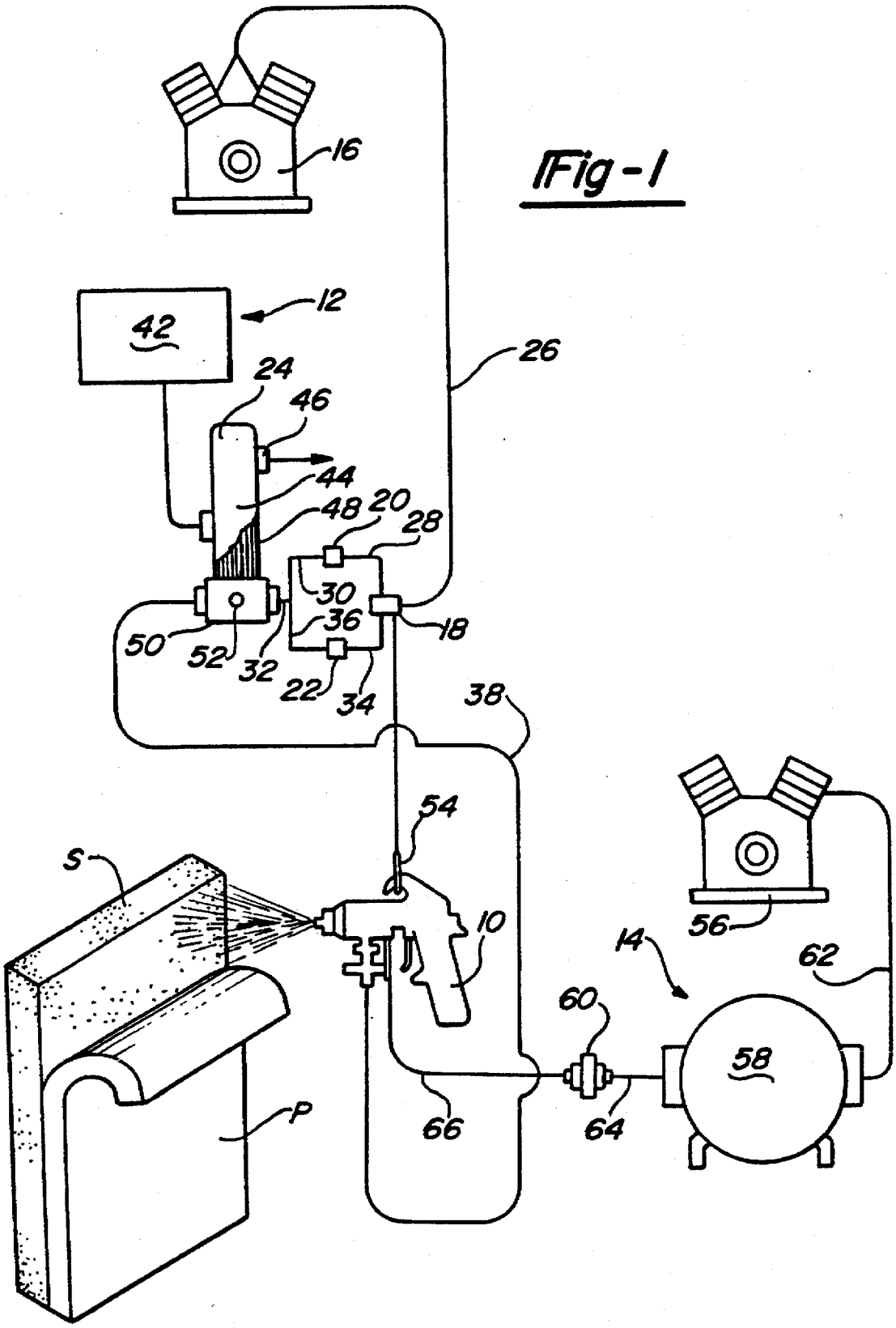
FIG. 1 is an environmental view illustrating a spraying system incorporating the hot air gun of the present invention for application of an air-dryable liquid material such as an adhesive to an article to be fastened to another article.

The drawing discloses the preferred embodiment of the present invention. While the configurations according to the illustrated embodiment are preferred, it is envisioned that alternate configurations of the present invention may be adopted without deviating from the invention as portrayed. The preferred embodiment is discussed hereafter.

With reference to FIG. 1, an environmental view of a spray application system incorporating a spray gun, generally illustrated as 10, is illustrated. The gun 10 combines air-dryable liquid with hot compressed air to produce a hot spray consisting of a hot air-liquid material mixture containing atomized air-dryable liquid material. An air heating and pressurizing assembly 12 and a liquid material delivery system 14 provide the air and liquid material to the gun 10, which then combines it as an air-liquid spray. While being effective for spraying liquid adhesives, the gun 10 of the present invention also finds application in the spraying of paints and other air-dryable liquid materials.

With the spraying of liquid adhesives primarily in mind, an air-adhesive spray is shown being applied to a substrate, generally illustrated as S, so that a piece, generally illustrated as P, may be attached thereto. The substrate S and piece P of FIG. 1 are only illustrative, and the system of the present invention may be used for adhering together any articles that may be bonded by an adhesive.

The air heating and pressurizing assembly 12 includes an air compressor 16 for compressing ambient air, a regulator selection switch 18 for switching air paths between a high-pressure regulator 20 and a low-pressure regulator 22, and a heat exchanger 24 for heating the compressed air. An air line 26 fluidly connects the compressor 16 with the regulator selection switch 18, a first compressed air input line 28 connects the switch 18 with the high-pressure regulator 20, and a high-pressure air line 30 connects the regulator 20 with a common air line 32. The common air line 32 is connected to the heat exchanger 24. A second compressed air input line 34 connects the switch 18 with the low-pressure regulator 22, and a low-pressure air line 36 connects the regulator 22 with the common air line 32. An insulated air line 38 connects the heat exchanger 24 with the gun 10.

The heat exchanger 24 is of known design and includes a heat source 42 powered by electricity or a flammable fuel that provides hot air to a distributor 44. An exhaust port 46 allows the hot, circulating air to exit the exchanger 24. The distributor 44 encases a series of sealed tubes 48 fluidly connected with a pressurized air channel 50 through which flows pressurized air regulated by the regulator 20 or the regulator 22, as will be described below. The pressurized air enters the channel 50, is circulated through the sealed tubes 48 which are surrounded by hot air, returns to the channel 50, and leaves the exchanger 24 to the gun 10. The heat exchanger 24 includes a temperature control knob 52 for selectively controlling the temperature of the exhausted compressed air.

The regulator selection switch 18 is fitted with a gun hanger 54 attached to the switch 18. While the gun 10 is in use, compressed air is directed by the switch 18 (and associated air tubing) to the high-pressure regulator 20 which regulates the incoming compressed air to an operating pressure of between 10–16 p.s.i. When the gun 10 is not in use, it is hung from the hanger 54, and the switch 18 diverts air from the line 28, through the line 34, and into the low-pressure regulator 22 which regulates the incoming compressed air to an idling pressure of between 1–2 p.s.i. (The heat exchanger 24 will not operate unless it receives at least 0.5 p.s.i. of compressed air at the channel 50.) A certain amount of air constantly exits a portion of the gun, as will be described in detail below.

The liquid material delivery system 14 includes a compressor 56 for compressing ambient air, liquid material tank 58, and a fluid regulator 60. An air line 62 connects the compressor 56 to the tank 58, a first liquid material line 64 connects the tank 58 to the regulator 60, and a second liquid material line 66 connects the regulator 60 with the gun 10. The liquid material contained in the tank 58 and forced into the gun 10 is liquid at room temperature, but dries when exposed to ambient air.

Figure 2:
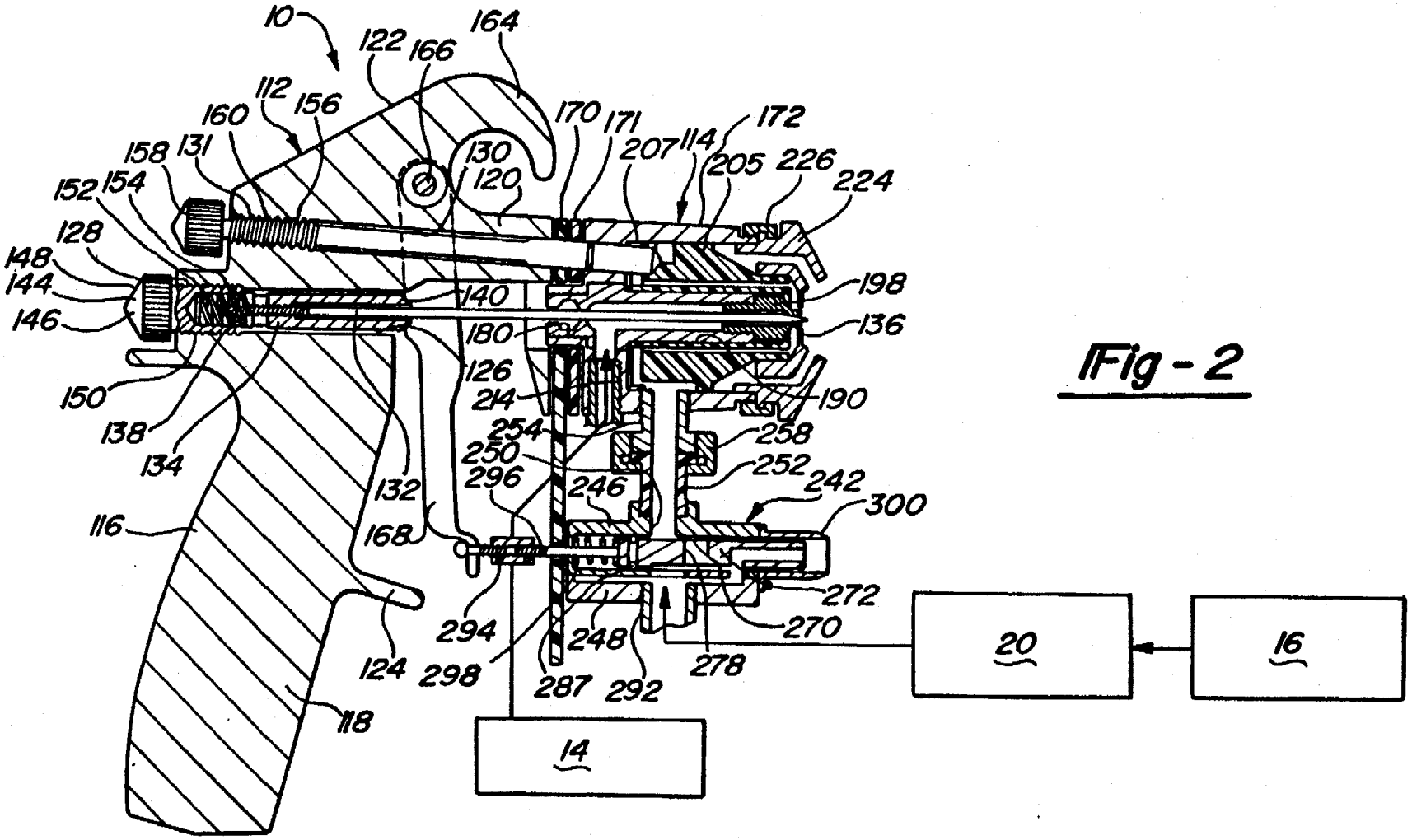
FIG. 2 is an elevational sectional view of the hot air gun of the present invention.
Figure 3:
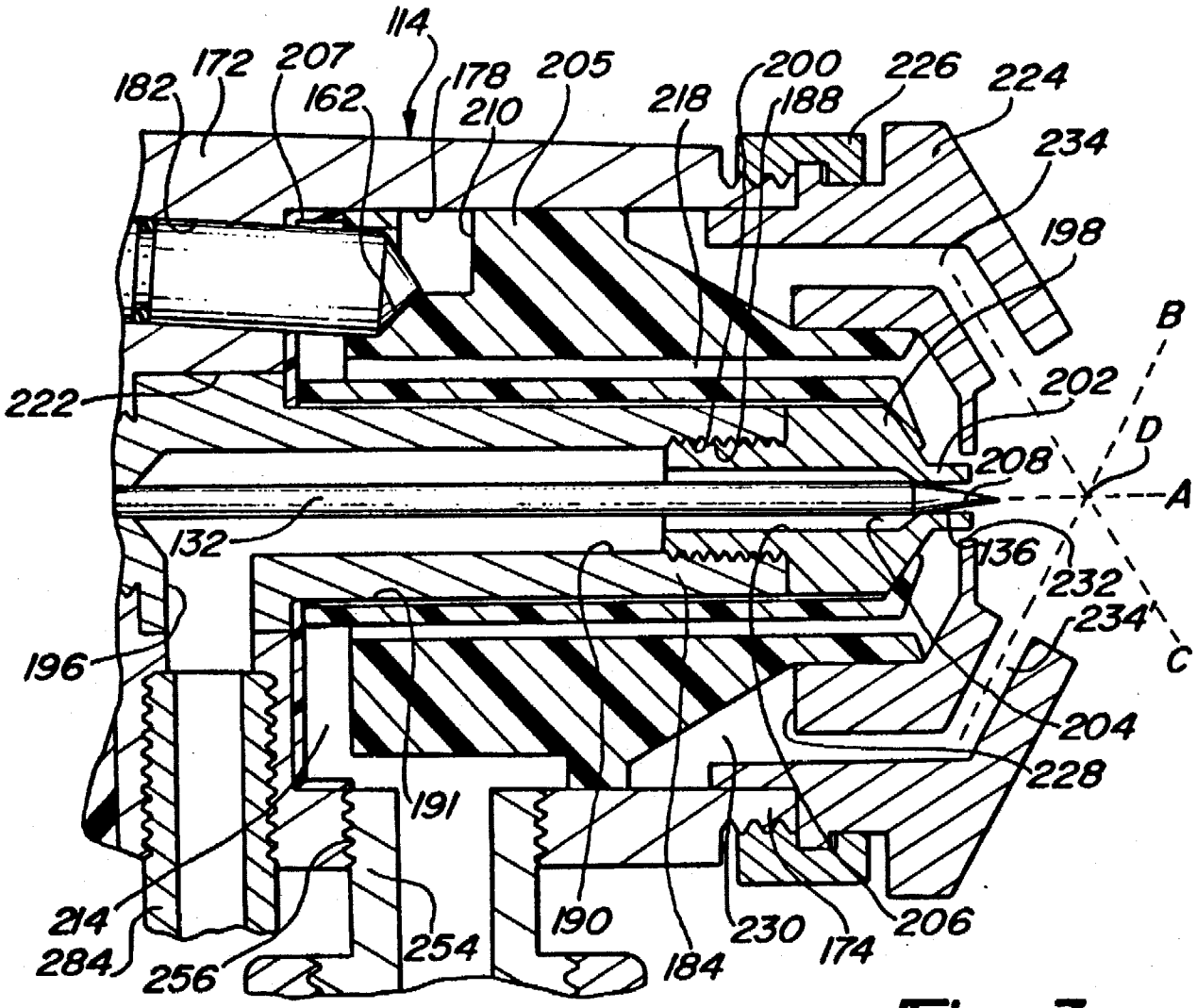
FIG. 3 is an enlarged portion of the sectional view of FIG. 2 illustrating the air insert of the present invention in its environment.
Figure 7:
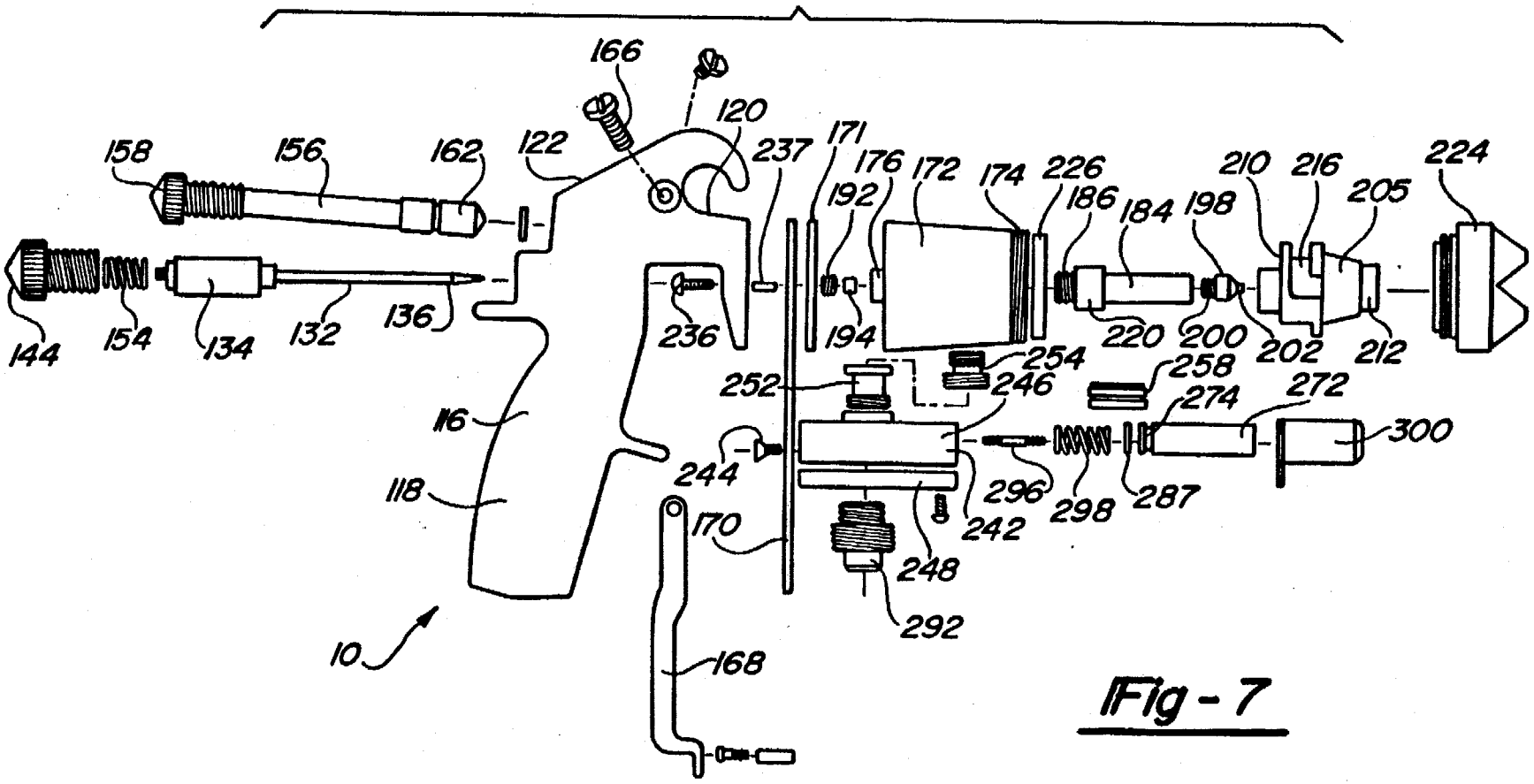
FIG. 7 is an exploded view of the hot air gun of the present invention.

Referring now to FIGS. 2, 3, and 7, the spray gun 10 according to the present invention is fully shown in section (in FIG. 2), is shown in part (in FIG. 3) and is shown in an exploded view (in FIG. 7). The gun 10 includes a handle assembly generally indicated as 112 and a spray assembly generally indicated as 114.

The handle assembly 112 includes a grip-type gun body 116. The body 116 is composed of a durable, lightweight material such as a plastic or a lightweight metal. The body 116 includes a grip portion 118, a spray assembly supporting portion 120, and an intermediate adjustment supporting portion 122. As illustrated, the grip portion 118 is configured to fit comfortably in the user's palm. To enhance the fit and to enable the user to better grip the gun 10, a finger support 124 is integrally mated with the grip portion 118.

The intermediate adjustment supporting portion 122 includes a first throughbore 126 having a threaded portion 128 and a second throughbore 130 having a threaded portion 131. The second throughbore 130 terminates at the spray assembly grip portion 118.

Within the first throughbore 126 is provided an axially-adjustable fluid adjusting needle 132 having a needle adjusting sleeve 134 and a pointed end 136, the function of which will be described in detail below. The adjusting sleeve 134 includes a spring biasing end 138 and a trigger abutment end 140.

A fluid volume control assembly 144 includes a knob 146 having a knurled end 148 and an opposite threaded end 150. The threaded end 150 is threadably adapted for mating with the threaded portion 128 of the throughbore 126. A counterbore 152 is defined within the threaded end 150 and extends into the knob 146. Nested substantially within the counterbore 152 is a fluid volume control return spring 154 that is biased between the endwall of the counterbore 152 and the spring biasing end 138 of the adjusting sleeve 134. The return spring 154 maintains the adjusting sleeve 134 in spaced-apart relation from the control assembly 144.

Within the second throughbore 130 is provided an axially-adjusted fan air control rod 156 having a knurled end 158, a threaded portion 160 adjacent the knurled end 158, and a conically-shaped shut-off end 162. The threaded portion 160 is threadably adapted for mating with the threaded portion 131 of the throughbore 130. The shut-off end 162 extends beyond the end of the spray assembly supporting portion 120 and into the spray assembly 114 as will be described in greater detail below.

A hanger 164 extends from the adjustment supporting portion 122 and enables the gun 10 to be hung, when not in use, on the hanger 54 as described above. While the hanger 164 is represented as having a particular "C"-shaped configuration, it must be understood that alternate configuration could as well be used.

Pivotally attached to the adjustment supporting portion 122 by a trigger axle 166 is a trigger 168. The trigger 168 is manipulated by the hand of an operator (not shown) to control the air-liquid material mixture escaping from the gun 10. The back side of the trigger 168 abuts the trigger abutment end 140 of the adjusting sleeve 134. When the operator squeezes the trigger 168 toward the grip portion 118, the spring 154 is compressed between the spring biasing end 138 of the sleeve 134 and the interior wall of the counterbore 152 of the knob 146. The spring 154 resists this movement and urges the trigger 168 forward to its resting position, as illustrated.

Between the handle assembly 112 and the spray assembly 114 is a spray assembly insulating plate 170 mated with an insulating disk 171. The temperature of the air entering the gun 10 is elevated to an operating temperature of between 325°–400° F., while the temperature of the glue entering the gun is elevated to an operating temperature of about 110° F. (but preferably below 120° F.). The insulation provided by the plate 170 and the disk 171 thus limits the transfer of heat from the spray assembly 114 to the handle assembly 112, enabling the operator to use the gun 10 with a reasonable degree of comfort. The plate 170 and the disk 171 are preferably composed of a rigid insulating polymerized material such as "Ultem" (trademark, GE Company) which is a polyetherimide resin.

The spray assembly 114 comprises several screw- or bolt-together components that are preferably composed of one of several rigid plastics or of a lightweight metal such as aluminum. The assembly 114 includes air and liquid material routing channels. The liquid material routing channels (described below) are preferably composed of stainless steel. While naturally elevating manufacturing costs, stainless steel provides an advantage over brass in that many liquid materials (such as liquid adhesive) react with the brass such that the exposed portion of the brass tarnishes. Stainless steel demonstrates no such reactive characteristics. The assembly 114 includes a spray head module 172 having a slightly tapered body as illustrated. The module 172 includes an externally threaded end 174 and a sleeve end 176. Internally the module 172 defines a central counterbore 178 that opens toward the threaded end 174 and is continuous with the sleeve end 176 via a threaded throughbore 180. An additional smooth throughbore 182 is continuous between the exterior of the module 172 and the internal counterbore 178 to accommodate the shut-off end 162 of the rod 156.

Within the counterbore 178 is fitted a fluid tube 184 having an externally threaded end 186 and an internally threaded end 188. An axially-defined central throughbore 190 is defined within the fluid tube 184 and is continuous between the ends 186 and 188.

The threaded end 186 of the tube 184 is threadably mated with the threaded throughbore 180. A packing nut 192 is also threadably mated with the threaded throughbore 180. Between the inner side of the packing nut 192 and the end of the tube 184 is provided a packing 194 composed of a liquid-resistant material. The packing 194 is forced between the nut 192 and the tube 184 to create a fluid-tight seal, thus preventing fluid from escaping from the module 172 along the needle 132. The throughbore 190 intersects a radially-aligned fluid inlet bore 196. A fitting 284 is fitted in the bore 196 for fluid communication with the liquid material delivery system 14.

At the end of the tube 184 is a fluid nozzle 198 having an external thread 200 and a fluid tip 202. The thread 200 is threadably mated with the threaded end 188 of the tube 184. An axially-defined central throughbore 204 is defined within the nozzle 198. The throughbore 204 includes a wide region 206 that communicates with the throughbore 190 and a restricted region 208 that provides a seat for the pointed end 136 of the needle 132 within the tip 202.

It may be accordingly understood that clockwise rotation of the knob 146 further biases the spring 154 against the adjusting sleeve end 134 urging the assembly so that the pointed end 136 extends further toward the needle seat defined within the nozzle 198. Counterclockwise rotation of the knob 146 causes the pointed end 136 to move away from the seat.

Figure 4:
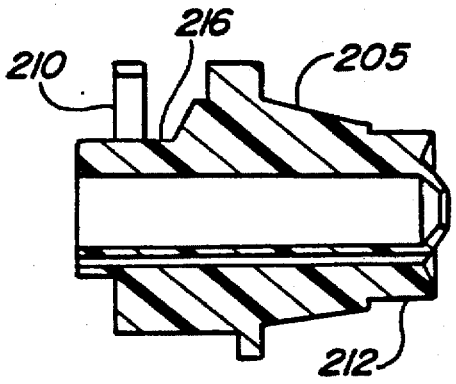
FIG. 4 is a sectional view of one side of the air insert of the present invention.
Figure 5:
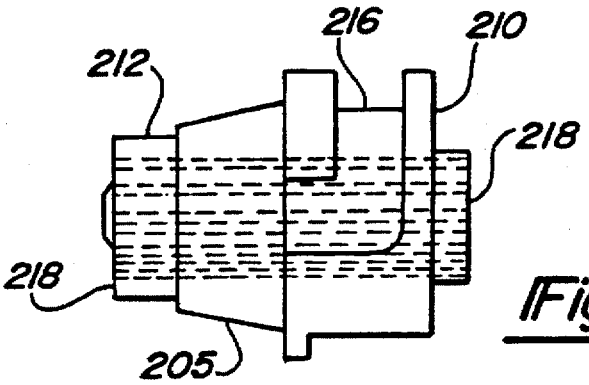
FIG. 5 is a view illustrating the side of the insert opposed to the side shown in FIG. 4.
Figure 6:
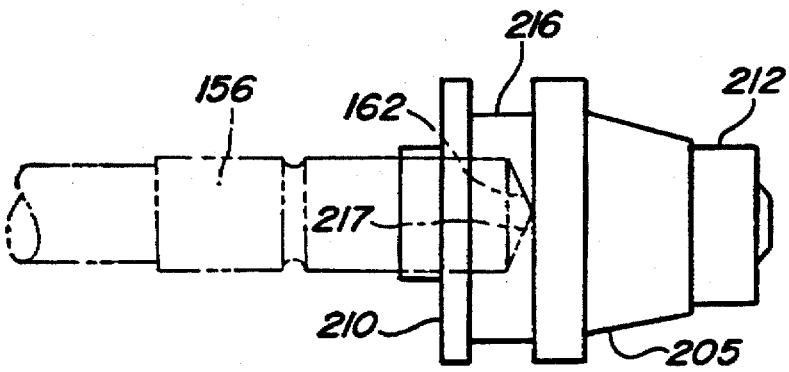
FIG. 6 is a top view of the insert shown in FIGS. 4 and 5.

Also fitted within the counterbore 178 of the head module 172 is an air routing insert 205. The insert 205 is best seen in FIGS. 4 through 6 which show it in various views. The insert 205 includes a cavity-defining end 210 and a nozzle end 212. As illustrated in FIGS. 2 and 3, the cavity-defining end 210 of the insert 205 is disposed within the module 172 in a spaced-apart relationship from an insulating cup 207 of the counterbore 178, thus defining a cavity 214. The cavity 214 is an air passage that fluidly communicates with the air heating and pressurizing assembly 12 described above.

An air-routing channel 216, best seen in FIGS. 5 and 6, is defined on the outside of the insert 205. The channel 216 is initially defined at the top dead center of the insert 205 (best seen in FIG. 6) an then curves down along the long axis of the insert 205 on both sides, defining a continuous channel. A seat 217, shown in FIG. 6, is defined at that point of the channel 216 that is top dead center of the insert 205 for seating the shut-off end 162 of the rod 156. The end 162 is shown in shadow lines in FIG. 6 in its fully seated position, thus closing off air flow between the cavity 214 and the channel 216. The channel 216 directs a controlled amount of air in two separate streams toward the tip of the fluid nozzle 198.

Rotation of the knurled end 158 in a clockwise direction adjusts the rod 156 forward into the seat 217 of the air-routing channel 216 reducing the amount of hot pressurized air entering the channel. Counterclockwise rotation of the knurled end 158 achieves the opposite result.

A series of air passageways 218, best seen in FIGS. 3 and 5, are defined in an array around a central throughbore 191 of the insert 205. The passageways 218 allow passage of hot pressurized air between the cavity 214 and the nozzle end 212. The air routing insert 205 and the insulating cup 207 are each composed of an insulating rigid polymerized material which is preferably the same polyetherimide resin used in the spray assembly insulating plate 170 and the insulating disk 171 described above. Accordingly, the hot air entering the gun is thereby further insulated from heating the heat-transmissive metal of the assembly 114. In addition, while the air passing through the air routing channel 216 contacts the module 172, the air passing between the cavity 214 to the nozzle end 212 through the air passageways 218 never contacts any metal components, thus minimizing the loss of heat through transmission to the metal and dissipation into surrounding ambient air.

The tube 184 includes an annular flange 220 adjacent the threaded end 186 that fits snugly into a bore 222 defined between and concentric with the throughbore 180. Seated in this manner, part of the tube 184 is suspended within the central throughbore 191 defined axially within the insert 205. This is best seen in FIG. 3.

Attached to the threaded end 174 is an air cap 224 fastened to the module 172 by an internally threaded ring 226. The air cap 224 includes an inner wall 228 that is positioned in spaced-apart relation from the nozzle-supporting end of the tube 184, thus defining a cavity 230. A circular aperture 232 is defined in the inner wall 228 through which the tip 202 of the nozzle 198 is disposed. The aperture 232 is larger than the circumference of the tip 202, and an air passage in the shape of a ring is defined between the two. In operation, hot pressurized air from the cavity 214 passes through the passageways 218 and along the tip 202 through the aperture 232, where it forms a spray stream with the liquid material, the stream being generally indicated as A in FIG. 3, exiting from the middle of the tip 202. The liquid material is atomized by this current of air.

The cap 224 includes a pair of opposed air channels 234 and 234'. These channels 234 and 234' are in fluid communication with the cavity 214, thus providing two opposed fanning air currents B and C that exhaust the air cap 224 concurrent with the air-liquid material mix A. The two air currents B and C exiting the cap 224 are directed angularly toward one another such that they intersect each other and the stream A in front of the tip 202 approximately at point D. The intersecting air currents B and C fan the current A to form a controlled (via operator adjustment of the control rod 156) lay-down pattern of the liquid material.

The assembly 114 is connected to the grip portion 118 by a pair of fasteners of which one, 236, may be seen. The fastener 236 and its unseen twin are provided to both sides of a dowel pin 237. The fasteners 236 are preferably screws that are provided through the plate 170, the insulating disk 171, and into the module 172.

The spray assembly insulating plate 170 provides support for an air diverter 242, shown in FIG. 2. The air diverter 242 provides drying air to the sprayed material to accelerate the set time. The drying air passes through a shroud 300. Air enters the gun 10 and is used either for atomizing and fanning the adhesive or is diverted to the diverter 242 for drying the adhesive after it is sprayed onto the substrate (S). An air diverter piston 272 having a sealing O-ring 287 is axially movable within a bore 270 of a diverter body 246 and is movable between a first, air-blocking position (as illustrated in FIG. 2) and a second, air-passing position. The diverter 242 includes a plenum 248 attached to the underside of the body 246. A piston control assembly 294 controls axial movement of the piston 272. The assembly 294 includes a connecting rod 296 that connects the lowest end of the trigger 168 with the piston 272. A piston return spring 298 is provided to urge the piston 272 toward its closed position. An air inlet hose fitting 292 is fitted at the base of the diverter body 246. The air line 38 (shown in FIG. 1) connects with the inlet 292. As will be described below in greater detail, when the gun 10 is hung upon the hanger switch 54, the pressure to the gun 10 is reduced. However, at all times a small amount of air is allowed to pass through the diverter 242 so that a positive pressure is created at the open end of the shroud 300 thereby preventing the unintentional but problematic build-up of adhesive in the working parts of the diverter 242. This design serves the added functions of preventing the heat exchanger 24 from overheating while also allowing enough air to pass through the exchanger 24 so that a full warm up of the exchanger 24 is eliminated on the subsequent use of the gun 10. The diverter 242 and its operation is fully explained in our copending application Ser. No. 08/355,838, filed on Dec. 14, 1994.

On the upper side of the diverter 242 is provided a pressurized fluid exhaust port 250. The exhaust port 250 is fluidly connected with the cavity 214 defined between the cup 207 of the module 172 and the insert 205 by an air insulating outlet fitting 252 and an air inlet fitting 254. Like the insulating plate 170, the insulating disk 171, the routing insert 205, and the insulating cup 207, the insulating outlet fitting 252 is composed of an insulating polymer such as a polyetherimide resin. The combination of the mated plate 170 and the disk 171 together with the insulating outlet fitting 252 act to isolate the module 172 from both the handle assembly 112 and the air diverter 242. This isolation prevents transmission and dissipation of heat from the pressurized air in the gun. The top end of the air inlet fitting 254 is threaded into an aperture 256 defined in the underside of the module 172. The top end of the air insulating outlet fitting 252 is mated with the air inlet fitting 254 by a ring nut 258. The bottom end of the air insulating outlet fitting 252 is threaded into the exhaust port 250. Compressed air passing through the air diverter 242 is thus in fluid communication with the cavity 214 through the fittings 252 and 254.

An air inlet hose fitting 292 is threadably attached to the underside of the air diverter 242. Hot pressurized air enters the lower end of the air inlet hose fitting 292 and is directed into the air diverter 242. The position of a control piston 272 determines whether or not compressed air is allowed to enter the gun 10 from the fitting 292. The piston 272 has defined therethrough a transverse bore 278 that, when aligned between the passageway defined through the fitting 292 and the fitting 252, permits the passage of pressurized air into the gun 10 to the cavity 214.

Operation of the gun 10 of the present invention is as follows. When the trigger 168 is in its closed or resting position, as illustrated, flow of the pressurized and heated air into the cavity 214 is blocked by the closed, non-aligned position of the piston 272. The pointed end 136 of the needle 132 is also seated in the tip 202 of the nozzle 198.

When the operator squeezes the trigger 168 toward the grip portion 118, two events simultaneously occur. First, the piston 272 is moved leftward (from the perspective of an observer viewing the various figures) in response to leftward movement of the connecting rod 296, and heated and pressurized air enters the cavity 214, passing both around the tip 202 and through the air channel 216, while also passing through the channel 216 and out of the air cap 224 through the air channels 234 and 234'. Second, the liquid material in the throughbore 190 is allowed to pass through the tip 202 in response to the point of the needle 132 being drawn away from its seat within the nozzle 198 on the action of the sleeve 134 being rearwardly acted upon by the trigger 168.

Adjustment of both flow of the liquid material out of the tip 202 and flow of the air comprising the air fan may be readily made. Flow of the liquid adhesive material is adjusted by rotation of the knob 146 clockwise or counterclockwise as set forth above. The amount of fan air passing through the channel 216 is controlled by rotation of the knurled end 158 of the rod 156 also as set forth above.

The construction and operation of the gun 10 being thus explained, the process of using the present invention may now be set forth.

With the gun 10 hung on the hanger 54 and with the tank 48 being filled with a liquid material, particularly a water-based adhesive, the compressors 16 and 46 as well as the heat exchanger 24 are activated. The operator must thereafter wait about two minutes to allow the heat exchanger 24 to warm to its operating temperature. (The control knob 52 of the heat exchanger 24 is adjusted to between 125 and 600 degrees F.) The gun 10 is removed from the hanger 54 and because the compressed air passes through the high pressure regulator 22, the pressure delivered to the gun increases to its operating pressure of between 10 and 16 p.s.i. (The pressures may be adjusted and varied more or less depending upon rheology of the particular adhesive used.) The operator adjusts the knurled end 158 of the rod 156 to control the pattern of the spray and adjusts the knob 146 to control the amount of liquid material in the spray. The liquid material is released from the gun 10 when the operator depresses the trigger 168.

Drying time of the sprayed material depends on the ambient air conditions (temperature and humidity), film thickness, and the temperature of the heated compressed air. After the preferred amount of material is sprayed, the gun 10 is returned to the hanger 54, compressed air is diverted by the switch 18 through the low-pressure regulator 20, and pressure is reduced to between 1–2 p.s.i., thus saving energy while keeping the system on a stand-by status for the next spraying operation. Once operations are complete, any remaining liquid material is flushed out of the gun 10 with clean water.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A system for spraying liquid materials, said system comprising:

a spray gun having a liquid material channel for carrying liquid material and a hot pressurized air channel for carrying hot pressurized air, said gun further including an air routing insert having a long axis, said air routing insert further including an outer peripheral wall, said wall having a channel defined thereon which forms at least a part of said hot pressurized air channel, said insert having an axially-defined throughbore, said gun further including a nozzle, said nozzle being disposed substantially within said throughbore of said insert, said nozzle having a long axis, said nozzle having an axially-defined throughbore, said liquid material channel being continuous with said throughbore of said nozzle, said insert further including a plurality of air passageways axially defined in an array around said throughbore of said insert, said air passageways being continuous with said hot pressurized air channel, said throughbore of said nozzle and said passageways opening in proximity with one another such that said liquid material discharging from said throughbore of said nozzle is atomized in an air-liquid stream by said hot pressurized air discharging from said passageways surrounding said throughbore of said insert, said spray gun further having incorporated therewith a control valve operatively associated with said insert for selectively controlling the flow of hot air through said insert;

a source of hot pressurized air;

an air line connecting said source of hot pressurized air with said hot pressurized air channel of said gun;

a source of liquid material; and a liquid material line connecting said source of liquid material with said liquid material channel of said gun.

2. The system of claim 1, wherein said gun includes a liquid material control valve operatively associated with said throughbore of said nozzle for adjusting the amount of liquid material entering said air-liquid stream.

3. The system of claim 1, wherein said insert of said gun further includes a first air fanning channel and a second air fanning channel, said channels being continuous with said hot pressurized air channel, said first channel discharging said hot pressurized air on a first side of said air-liquid stream, said second channel discharging said hot pressurized air on a second side of said air-liquid stream, said first and second channels being opposed to each other.

4. The system of claim 3, wherein said gun includes a control valve operatively disposed between said hot pressurized air channel and said first and second air fanning channels for controlling the volume of air entering said air fanning channels.

5. The system of claim 1, wherein said source of hot pressurized air comprises a compressor and a unit for heating air, said air line connecting said source of hot pressurized air with said hot pressurized air channel of said gun comprising a first air line connecting said compressor and said unit for heating and a second air line connecting said unit for heating and said gun, said source of hot pressurized air further including insulation provided about said second air line.

6. The system of claim 5, wherein said unit for heating air comprises a heat exchanger, said heat exchanger further including a temperature control.

7. The system of claim 1, wherein said liquid material is an adhesive.

8. The system of claim 1, wherein said liquid material is a glue.

9. The system of claim 1, wherein said source of liquid material comprises a liquid material storage tank, a compressor, a compressor line connecting said tank with said compressor, and a liquid material line connecting said tank and said liquid material channel of said gun.

10. The system of claim 9, wherein said liquid material line includes a liquid material regulator.

11. A spray gun for spraying a liquid material, said gun comprising:

a handle assembly and a spray nozzle assembly, said handle assembly including a trigger, said spray nozzle assembly being attached to said handle assembly, said spray nozzle assembly including:

a spray head module having an open end and a first bore and a second bore, said bores being coaxial, said first bore being wider than said second bore, said first bore being adjacent said open end and a second end;

a fluid tube, said fluid tube having a flange end and a nozzle end, said tube having a flange defined on said flange end, said flange of said tube being fitted within said second bore of said spray head module, said fluid tube having a central throughbore;

a spray nozzle, said spray nozzle having a central liquid-material-passing throughbore, said spray nozzle being attached to said nozzle end of said fluid tube;

a spray needle, said spray needle having a first end operatively attached to said trigger and a second end movably disposed within said throughbore of said spray nozzle, said spray needle being movable by said trigger between a liquid-material-blocking position and a liquid-material-passing position;

an air routing insert, said air routing insert having a first end and a second end with a throughbore defined therebetween, said fluid tube being partially disposed within said throughbore of said insert, said insert being disposed within said first bore of said head module such that a first cavity is defined between said insert, said fluid tube, and said first bore of said module, said insert having an outer peripheral wall, said wall having an air channel defined thereon, said insert having a plurality of air passageways defined between said first and second ends of said insert, said plurality of passageways being arrayed around said throughbore;

a cap, said cap being attached to said open end of said module, said cap having a pair of opposed air passageways defined therein, said cap being attached to said module such that a second cavity is defined between said cap and said spray nozzle, said cap having an aperture centrally defined therein for allowing passage of said liquid material and said hot compressed air, said cap further being attached to said module such that a third cavity is defined between said module, said insert and said cap;

said plurality of passageways of said insert being continuous between said first cavity and said second cavity, whereby said compressed air passes through said second cavity and surrounds said nozzle as it is discharged through said aperture defined in said cap, said compressed air being discharged through said aperture in close proximity to said liquid material being discharged from said spray nozzle such that said liquid material is atomized.

12. The spray gun of claim 11, wherein said gun is fluidly connected to a source of hot pressurized air.

13. The spray gun of claim 11, wherein said gun is fluidly connected to a source of liquid material.

14. The spray gun of claim 13, wherein a liquid control valve is fitted between said gun and said source of liquid material, said valve being operatively attached to said trigger of said gun, said valve being operable between a liquid-passing position and a liquid-blocking position.

15. A process for spraying a liquid material, said process comprising the steps of:

pressurizing ambient air with a first compressor to create a volume of pressurized air;

introducing said pressurized air into a unit for heating air;

heating said pressurized air in said unit for heating air to a preselected temperature;

pressurizing liquid material with a second compressor;

delivering said hot pressurized air and said pressurized liquid material to a spray gun;

regulating the flow of said air and said liquid material through said spray gun;

atomizing said liquid material as it is sprayed out of said gun using said hot pressurized air to create an air-liquid spray;

laying down said air-liquid spray onto a substrate; and drying said spray on said substrate using hot pressurized air diverted through an air diverter fitted to said spray gun.

16. The process for spraying of claim 15, further including the step of fanning said air-liquid spray with a pair of opposing air streams to establish a selected pattern on said substrate.

17. The process for spraying of claim 16, further including the step of adjusting a control mechanism on said gun to regulate the amount of air in said two opposing air streams.

18. The process for spraying of claim 16, wherein each of said pair of opposing air streams is composed of said hot pressurized air.

19. The process for spraying of claim 15, wherein said step of regulating said liquid material through said spray gun includes adjusting a control mechanism on said gun to regulate the amount of the liquid material part of said air-liquid spray.

20. The process for spraying of claim 15, wherein said preselected temperature of said step of heating said pressurized air is between 125 and 600 degrees Fahrenheit.

21. The process for spraying of claim 15, wherein said liquid material is an adhesive.

22. The process for spraying of claim 15, wherein said liquid material is a paint.

23. The process for spraying of claim 15, further including the step of allowing said unit for heating air to arrive at its operating temperature prior to said step of atomizing said adhesive.

24. The process for spraying of claim 15, wherein said liquid material is water-based.

25. A spray gun for spraying a liquid material, said gun comprising:

a handle assembly and a spray nozzle assembly, said handle assembly including a trigger, said spray nozzle assembly being attached to said handle assembly, said spray nozzle assembly including:

a spray head module having an open end and a first bore and a second bore;

a fluid tube, said fluid tube having a flange end and a nozzle end, said tube having a flange defined on said flange end, said flange of said tube being fitted within said second bore of said spray head module;

a spray nozzle, said spray nozzle having a central liquid-material-passing throughbore, said spray nozzle being attached to said nozzle end of said fluid tube;

a spray needle, said spray needle having a first end operatively attached to said trigger and a second end movably disposed within said throughbore of said spray nozzle, an a routing insert, said air routing having a first end and a second end with a throughbore defined therebetween, said fluid tube being partially disposed within said throughbore of said insert;

a cap, said cap being attached to said open end of said module, said cap having an air passageway defined therein.

* * * * *